United States Patent [19]

Kirkham et al.

[11] 4,398,869

[45] Aug. 16, 1983

[54] CONTROL MEANS FOR VARIABLE DISPLACEMENT PUMP

[75] Inventors: Steven C. Kirkham, McHenry; Ronald K. Schantz, Libertyville, both of Ill.

[73] Assignee: Dresser Industries, Inc., Dallas, Tex.

[21] Appl. No.: 439,703

[22] Filed: Nov. 8, 1982

Related U.S. Application Data

[63] Continuation of Ser. No. 153,120, May 27, 1980, abandoned.

[51] Int. Cl.[3] ..... F04B 49/00

[52] U.S. Cl. ..... 417/216; 60/447; 60/449; 417/218

[58] Field of Search ..... 417/216, 218–222; 60/445, 447, 449

[56] References Cited

U.S. PATENT DOCUMENTS

| | | | |
|---|---|---|---|
| 3,543,508 | 12/1970 | Schwab | 60/449 |
| 3,625,637 | 12/1971 | Kiwalle et al. | 417/218 |
| 3,789,943 | 2/1974 | Kampert et al. | 192/103 F |
| 3,902,320 | 9/1975 | Marietta | 60/445 |
| 3,963,378 | 6/1976 | McMillan | 417/216 |
| 4,115,033 | 9/1978 | Kleineisel et al. | 417/216 |
| 4,203,712 | 5/1970 | Uehara | 417/218 |

FOREIGN PATENT DOCUMENTS

| | | | |
|---|---|---|---|
| 2823559 | 12/1979 | Fed. Rep. of Germany | 60/447 |

*Primary Examiner*—Edward K. Look
*Attorney, Agent, or Firm*—Roy L. Van Winkle

[57] ABSTRACT

A control means for a variable displacement pump (12) driven by an engine (10) and having a servo-cylinder (78) determining the displacement of the variable pump (12). A charge pump (14) is driven by the engine (10) and supplies charge pressure to the variable pump (12) through an orifice (40). Pilot conduits (42,44) on each side of the orifice (40) sense the pressure drop due to flow and relay the resulting signals to each end of a metering spool (52) in a speed control valve (46), which is arranged to control the pressure in the servo-cylinder (78). A spring (90) biases the servo-cylinder (78) toward an extreme position for the variable pump (12) and opposes the pressure directed to the servo-cylinder (78) by the speed valve (46) in order to provide a smooth transition between the extreme positions for pump displacement.

2 Claims, 3 Drawing Figures

CONTROL MEANS FOR VARIABLE DISPLACEMENT PUMP

This is a continuation of application Ser. No. 153,120 filed May 27, 1980 now abandoned.

CROSS-REFERENCE TO RELATED APPLICATIONS

The invention disclosed and claimed herein is related to U.S. patent applications, U.S. Pat. No. 4,359,130 issued Nov. 16, 1982, by S. C. Kirkham and entitled HYDRAULIC SYSTEM FOR RESPONSIVE SPLITTING OF ENGINE POWER and Ser. No. 153,118 filed May 27, 1980 by S. C. Kirkham and entitled HYDRAULIC LOGIC CONTROL CIRCUIT FOR VARIABLE DISPLACEMENT PUMP. The referenced applications have a filing date and assignee common with this application.

BACKGROUND AND SUMMARY OF THE INVENTION

The need to divide the power of an engine between the tractive effort and power take-off load, such as hydraulics, has been recognized, even where engine speed is maintained independent of ground or travel speed, such as disclosed in U.S. Pat. No. 3,789,943 issued Feb. 5, 1974 to K. W. Kampert and K. E. Houtz. In the patented arrangement, the engine was operated or governed to run at a "constant" speed and ground speed was determined by controlling the slip in a modulated pressure clutch. Various types of pump arrangements, also have been attempted in the prior art. Removal of a portion of the hydraulic load from the engine when the engine is operating at a high speed is not warranted and yet once the engine slows below the speed at which it develops full torque, it is susceptible to being "killed".

It is, therefore, an object of this invention to provide a means for controlling a variable displacement pump driven by an engine which will maintain full pump displacement at engine speeds above peak torque and will maintain minimum pump displacement at engine speeds below peak torque.

It is also an object of this invention to provide such a means which will produce a smooth transition between the aforesaid conditions.

It is a further object of this invention to provide a means for detecting engine speed and controlling the destroking and stroking of a variable displacement pump over a predetermined engine speed range.

It is another object to provide a speed valve which will smoothly and reliably develop and exhaust pressure to and from a servo-cylinder or control ram for a variable displacement pump.

These and other objects of the present invention, and many of the attendant advantages thereof, will become more readily apparent upon a perusal of the following description and the accompanying drawings, wherein.

DESCRIPTION OF A PREFERRED EMBODIMENT

Figure 1:
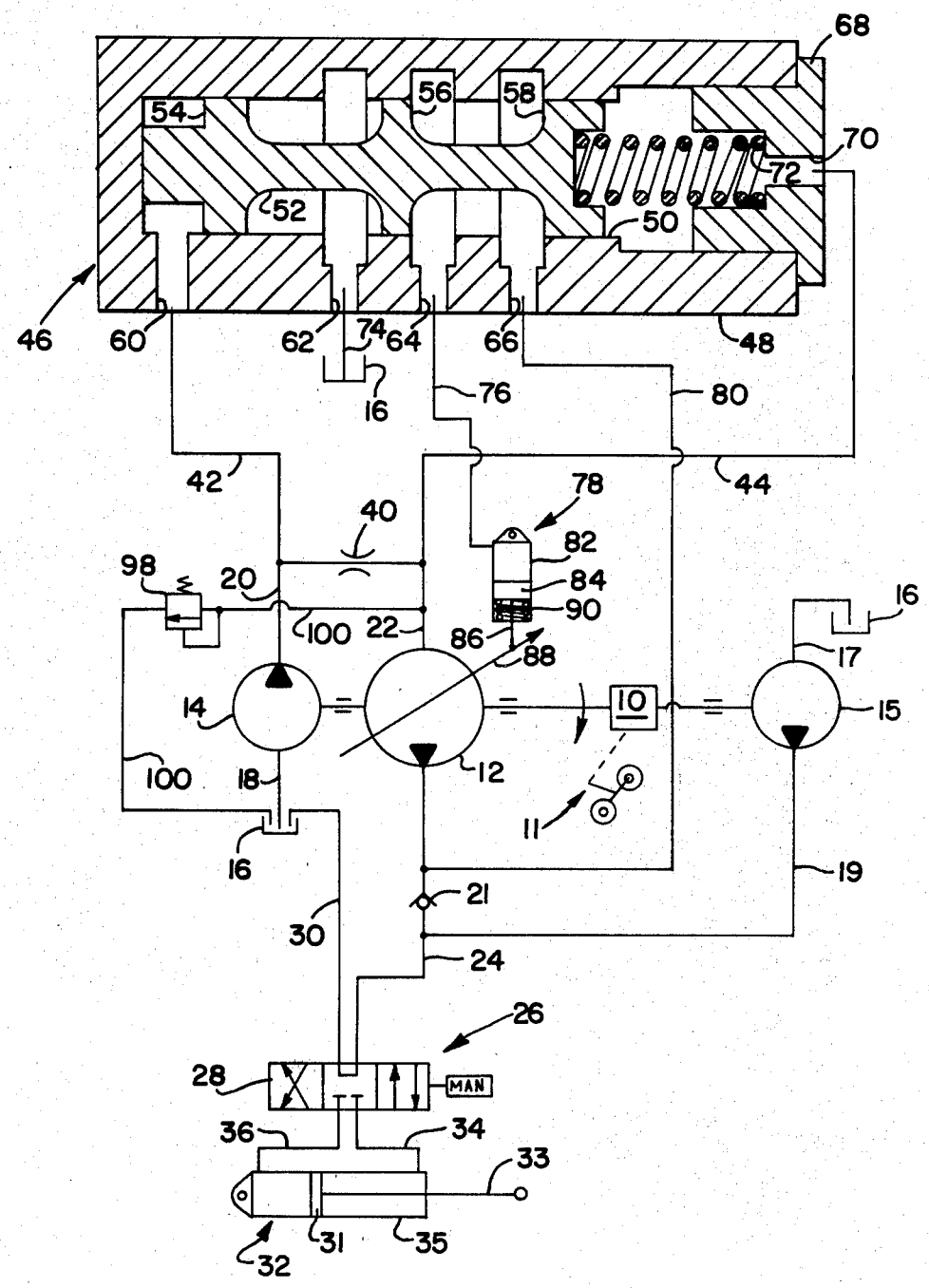
FIG. 1 is a schematic of a hydraulic system according to the present invention.

Referring now to FIG. 1, an engine, indicated at 10, is arranged to drive a tractive effort drive train, indicated generally at 11, a variable displacement pump 12, a fixed displacement charge pump 14 and a fixed displacement pump 15. The charge pump 14 draws hydraulic fluid from a reservoir 16 through a suction line 18 and discharges hydraulic fluid under pressure through conduit 20 to the inlet or suction side 22 of variable pump 12. Hydraulic fluid under pressure from the pump 12 is discharged through conduit 24 to a hydraulic work circuit, indicated generally at 26, for hydraulically actuated equipment, such as a boom and bucket conventionally provided on a wheeled loader, for example.

The work circuit 26 is also supplied with hydraulic fluid under pressure by the fixed displacement pump 15 which draws fluid from reservoir 16 through conduit 17 and discharges fluid under pressure into conduit 24 through conduit 19. A check valve 21, located in conduit 24 between its connection with conduit 19 and the pump 12, permits flow only from the pump 12 toward the valve 28, and thereby serves to isolate the fixed pump 15 from the variable pump 12 and its control circuit. The work circuit 26 is exemplified by an open-center directional control valve 28 connected to conduit 24 with a return conduit 30 connecting the valve 28 to the reservoir 16. A hydraulic ram 32, having a piston 31 and affixed rod 33 reciprocable in a cylinder 35, has its rod end connected by a conduit 34 to the valve 28 and its head end connected thereto by conduit 36. Shifting the spool of valve 28 to the left from its center neutral position, as shown in the drawing, will connect pressure conduit 24 with conduit 34 while connecting conduit 36 to return conduit 30 causing the piston 31 to be moved to the left, contracting the ram 32. Similarly, shifting the spool of valve 28 to the right will interconnect conduit 24 with conduit 36 and conduit 36 with conduit 30 causing the ram 32 to be extended.

A fixed orifice 40 is positioned in discharge conduit 20 with a pilot conduit 42 connected therein upstream of the orifice 40 and a similar pilot conduit 44 downstream. The pilot conduits 42 and 44 connect with an engine speed responsive valve, indicated generally at 46. The valve 46 has a valve body 48 having a central bore 50 with a spool 52 reciprocable therein. The spool 52 is provided with grooves to define lands 54, 56 and 58. The valve body 48 has ports 60, 62, 64 and 66 positioned so that port 60 communicates with one end of the spool 52, the port 62 with the groove between lands 54 and 56, the port 64 with either the groove between lands 54 and 56 or the groove between 56 and 58, and the port 66 with the groove between lands 56 and 58. An end cap 68 closes the bore 50 and also has a port 70 which permits communication with the other end of the spool 52. A compression spring 72 is trapped between the spool 52 and the cap 68 and urges the spool 52 to the left to the position shown in FIG. 1. The pilot conduits 42 and 44 connect with ports 60 and 70 respectively. The port 62 communicates with the reservoir 16 through conduit 74. A conduit 76 connects the port 64 with a control ram 78, and a conduit 80 connects the port 66 with the discharge conduit 24 upstream of the check valve 21.

The control ram 78 has a cylinder 82 with a piston 84 and its affixed rod 86 reciprocable therein. The rod 86 is pivotally attached to the movable member 88, such as a swash plate, for example, of the variable pump 12 provided to change the displacement thereof. A compression spring 90 trapped within the cylinder 82 between the piston 84 and the rod end of the cylinder 82 urges the piston 84 toward the head end of the cylinder to thereby move the member 88 in a direction to increase the displacement of the pump 12.

When the engine 10 is operating at a high speed, the charge pump 14 will have a relatively large output which will flow through the orifice 40. The flow through the orifice 40 will create a pressure differential thereacross with the higher pressure being transmitted through pilot conduit 42 to port 60 and the lower pressure being transmitted through pilot conduit 44 to port 70. The force of the pressure acting on the left end of spool 52 will exceed the combined forces of the spring 72 and the lower pressure acting on the right end of spool 52. The spool 52 will be shifted to the right to a position wherein land 56 will block communication between the ports 66 and 64 while connecting port 64 with port 62. The conduit 76 will therefore be connected with the reservoir 16 through conduit 74. The spring 84 will force the piston 84 and its rod 86 to be contracted within the cylinder 82 causing the member 88 to condition the pump 12 for maximum flow. As the speed of engine 10 drops, the flow through the orifice 40 will be reduced and the pressure drop thereacross will also be reduced. At the point where the pressure force on the right end of the spool 52 plus the force of the spring under its compressed state just exceeds the pressure force on the left end of the spool 52, the spool 52 will move toward the left until the reduced spring force due its slight extension has reduced the total force acting on the right end of the spool. Gradual movement of the spool 52 toward the left will continue as a direct function of reductions in the engine speed. The land 56 will, as a consequence, move across the port 64 progressively increasing communication between the conduits 80 and 76, while simultaneously progressively decreasing communication between the ports 64 and 62. The pressure within the conduit and hence within the cylinder 82 will progressively increase. As the pressure acting on the top of the piston 84 increases, the piston will move downward compressing the spring 90 and destroking the pump 12, i.e. decreasing its displacement. Since the charge pump 14 is not directly involved in the work circuit 26, the flow therefrom will be related only to the speed of the engine 10.

In order to assure a continuous flow of fluid through the orifice 40, even when the pump 12 is at its minimum displacement, a pressure relief valve 98 is positioned in a conduit 100 connected between the conduit 22 and the reservoir 16. The relief valve 98 is set to open at a pressure, e.g. 165 psi, which is relatively low but sufficient to provide charge pressure to the variable displacement pump 12.

Figure 2:
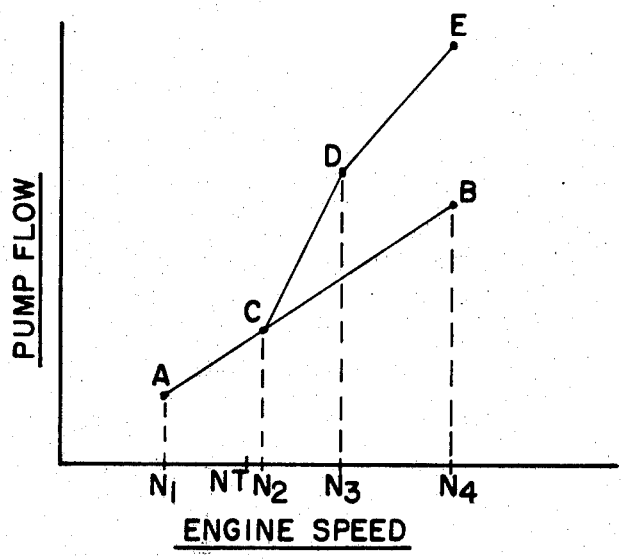
FIG. 2 is a graph showing pump flow as a function of engine speed for the hydraulic system of FIG. 1.

Referring now to FIG. 2, the flow from the fixed displacement pump 15 as function of the speed of the engine 10 is depicted by the straight line AB. The line DE depicts the combined flow of the pumps 12 and 15 as a function of engine speeds between N3 and N4 when the variable displacement pump 12 is at maximum displacement. The line CD depicts the transition ramp between zero displacement of pump 12 at point C to full displacement at point D. The point C is set so that the speed of the engine N2 is just slightly greater than the speed NT at which the engine 10 develops peak torque. The line CD represents a smooth transition ramp which is selected so that there is no sudden change in the operation of the hydraulic equipment and so that the operator feels no sudden change in tractive effort. It has been found in practice that a speed difference between N2 and N3 of approximately 200–300 rpm will provide an acceptable transition ramp.

Figure 3:
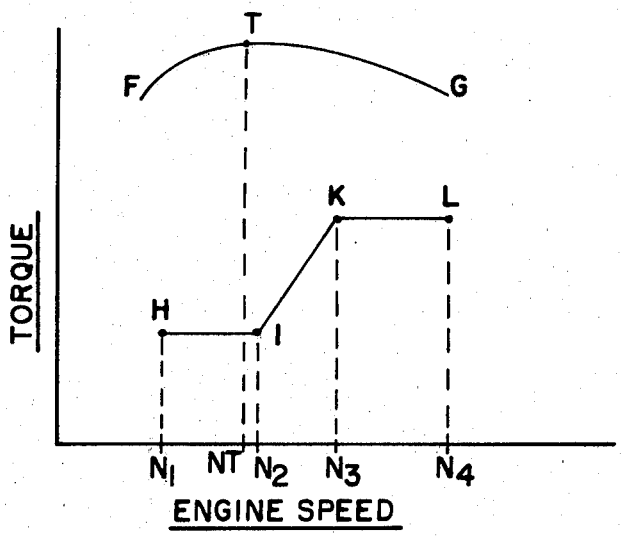
FIG. 3 is a graph of the torque as a function of engine speed.

Referring now to FIG. 3, the curve FG represents the torque output of the engine 10 with point T being the maximum or peak torque developed at the engine speed of NT. The input torque required to drive to fixed displacement pump 15 alone is presented by the line HI and the input torque required to drive both pumps 15 and 12, the later at full displacement, is represented by the line KL, with the line IK representing the progressively increasing torque required at the pump 12 goes from zero displacement at point I to full displacement at point K. The difference between the engine torque curve FG and the pump input torque curve HIKL represents the torque available for driving the power train 11. It will be appreciated that this arrangement permits the diversion of considerably more power or torque to the drive train under those conditions where the engine is lugged down and maximum tractive effort is required and yet power or torque is available to drive the pumps at high speed when pump flow requirements are high and tractive effort is small.

The hydraulic system disclosed and claimed herein is ideally suited for a vehicle of the type in which the engine in general to run at a "constant" speed and ground speed is controlled by varying the pressure to a modulated clutch, such as that disclosed in U.S. Pat. No. 3,789,943, and the disclosure thereof is specifically incorporated herein by reference.

While one embodiment of the present invention has been disclosed, it is to be understood that various changes and modifications may be made therein without departing from the spirit of the invention as defined by the scope of the appended claims.

What is claimed is:

1. Control means for a variable displacement pump driven by an engine, said control means comprising:

a movable control ram operably connected to said pump for regulating the output flow from said variable displacement pump between a maximum and a minimum;

biasing means urging said ram in a direction to provide maximum flow from said variable displacement pump;

a charge pump driven by the engine for supplying fluid under pressure to said variable displacement pump;

a first conduit extending from said charge pump to said variable displacement pump for carrying said fluid;

an orifice in said first conduit whereby said fluid flowing therethrough causes a pressure difference thereacross;

a second conduit extending between said variable displacement pump and said control ram;

a speed valve located in said second conduit and including a spring-biased spool movable therein in response to said pressure difference across said orifice, and independently of the output pressure of said variable pump between a first position permitting fluid flow to said control ram from said variable displacement pump and a second position preventing such flow;

a first pilot conduit connected between said first conduit on the downstream side of said orifice and one end of said speed valve and a second pilot conduit connected between said first conduit on the upstream side of said orifice and the other end of said speed valve, whereby, when said pressure difference is low, said spring-bias moves said spool to a position wherein said control ram is positioned to provide for maximum fluid flow from said variable speed pump, and, when said pressure difference is high, said spool is moved by higher pressure in said second pilot conduit to a position wherein said control ram provides for minimum fluid flow from said variable displacement pump.

2. The control means according to claim 1, and further comprising:

a fluid reservoir;

a third conduit extending from said first conduit downstream of said orifice to said reservoir; and, an adjustable pressure relief valve located in said third conduit set to open at a relatively low pressure whereby fluid from the charge pump continues flowing through said orifice, into said third conduit and into said reservoir when said variable pump is at its minimum output.

* * * * *